US009614282B1

(12) United States Patent
Zheng

(10) Patent No.: US 9,614,282 B1
(45) Date of Patent: Apr. 4, 2017

(54) MULTIMODE BROADBAND ANTENNA

(71) Applicant: Amazon Technologies, Inc., Seattle, WA (US)

(72) Inventor: Ming Zheng, Cupertino, CA (US)

(73) Assignee: AMAZON TECHNOLOGIES, INC., Seattle, WA (US)

( * ) Notice: Subject to any disclaimer, the term of this patent is extended or adjusted under 35 U.S.C. 154(b) by 0 days.

(21) Appl. No.: 14/744,534

(22) Filed: Jun. 19, 2015

(51) Int. Cl.

| | |
|---|---|
| ***H01Q 21/00*** | (2006.01) |
| ***H01Q 5/30*** | (2015.01) |
| ***H01Q 7/00*** | (2006.01) |
| ***H01Q 9/42*** | (2006.01) |
| ***H01Q 1/24*** | (2006.01) |
| *H01Q 5/00* | (2015.01) |
| *H01Q 21/06* | (2006.01) |
| *H01Q 1/40* | (2006.01) |

(52) U.S. Cl.
CPC ..... *H01Q 5/30* (2015.01); *H01Q 1/243* (2013.01); *H01Q 7/005* (2013.01); *H01Q 9/42* (2013.01); *H01Q 1/40* (2013.01); *H01Q 5/00* (2013.01); *H01Q 7/00* (2013.01); *H01Q 21/061* (2013.01)

(58) Field of Classification Search
CPC H01Q 7/00; H01Q 1/243; H01Q 5/00; H01Q 1/40; H01Q 21/061
USPC ..... 343/728, 702, 722, 833, 873, 893
See application file for complete search history.

(56) References Cited

U.S. PATENT DOCUMENTS

2004/0113847 A1* 6/2004 Qi ..... H01Q 1/243 343/702

* cited by examiner

*Primary Examiner* — Joseph Lauture
(74) *Attorney, Agent, or Firm* — Seyfarth Shaw LLP; Ilan N. Barzilay; Tyrus S. Cartwright

(57) ABSTRACT

A compact multimode broadband antenna that supports collocated resonances with very little destructive interference occurring between resonant modes. The antenna comprises a monopole element and a folded loop element that partially share structure, and are fed via a unitary RF feed port. The antenna is well suited for simultaneous dual band WLAN applications and ultra-wideband operations.

20 Claims, 12 Drawing Sheets

MULTIMODE BROADBAND ANTENNA

BACKGROUND

A large and growing population of users is enjoying entertainment through the consumption of digital media, such as music, movies, images, electronic books, and so on. The users employ various electronic devices to consume such media. Among these electronic devices (referred to herein as "user equipment" or "UEs") are electronic book readers, cellular telephones, personal digital assistants (PDAs), portable media players, tablet computers, netbooks, laptops, and the like. Providing a wide and increasing variety of applications and services, these electronic devices each include at least one antenna to support wireless communications with a communications infrastructure.

Mobile devices may include antennae capable of communication across multiple frequency bands. A single "multi-band" antenna may support communications on multiple frequency bands. Among other bands commonly supported by mobile devices are bands for 2.4 GHz and 5 GHz wireless local area network (WLAN) (i.e., IEEE 802.11 "WiFi" standards) communications, the 2.4 GHz band for Bluetooth communications, and various bands assigned to cellular data communications. Some services may be supported on some of the frequency bands available to a device but not on others.

In the United States, regulatory approval has been granted to a very low energy level, short-range, high-bandwidth communications technology generally referred to as "ultra-wideband." Ultra-wideband is approved for unlicensed use across a frequency range from 3.1 to 10.6 GHz. Within this spectrum, which is also used by several other communications technologies, communications are spread over a bandwidth exceeding the lesser of 500 MHz or 20% of the arithmetic center frequency. Uses for the technology include personal area networks (PANs) and close-proximity wireless data transfers between devices, such as the direct streaming video from a personal media device to a nearby display.

Progress on the development of standards utilizing ultra-wideband has been slow. One of the obstacles to adoption of the technology has been the difficulties relating to the design of antennae that can support efficient low power operation across a substantial portion of the ultra-wideband spectrum.

In view of the limited physical space available in mobile devices such as cellular telephones and tablet computers, the need to optimize space utilization, and the general trend for devices to get smaller—rather than larger—with each generation, increasing the space dedicated to antennae necessitates design trade-offs (e.g., reducing the size of the battery) that may result in improving one feature at the expense of another.

Past solutions to expand the bandwidth have resulted in increasing the size of multi-band antennae, such as adding multiple active tuning elements to extend bandwidth, or using separate antennae to achieve cover additional frequency bands. For example, one type of mutli-band antenna used in mobile devices is a Planar Inverted F Antenna (PIFA). A PIFA resembles an inverted F, which explains the PIFA name, and can be designed to have multiple branches that resonate at different radio frequencies. However, PIFA antennae typically exhibit a degree of parasitic coupling and destructive interference between resonant modes associated with the various tuning elements, reducing the overall efficiency of the design. Moreover, while PIFA can be designed to support resonance at more than one frequency band, they are poorly suited for wideband applications that require a broad range of the radio spectrum to operate. Efficient operation across the spectrum is particularly critical for ultra-wideband applications, as such communications use low power signals proximate to the background RF noise "floor."

BRIEF DESCRIPTION OF DRAWINGS

For a more complete understanding of the present disclosure, reference is now made to the following description taken in conjunction with the accompanying drawings. While several of the figures approximate proportions of various structures, they are not drawn to scale unless otherwise noted.

DETAILED DESCRIPTION

Figure 1A:
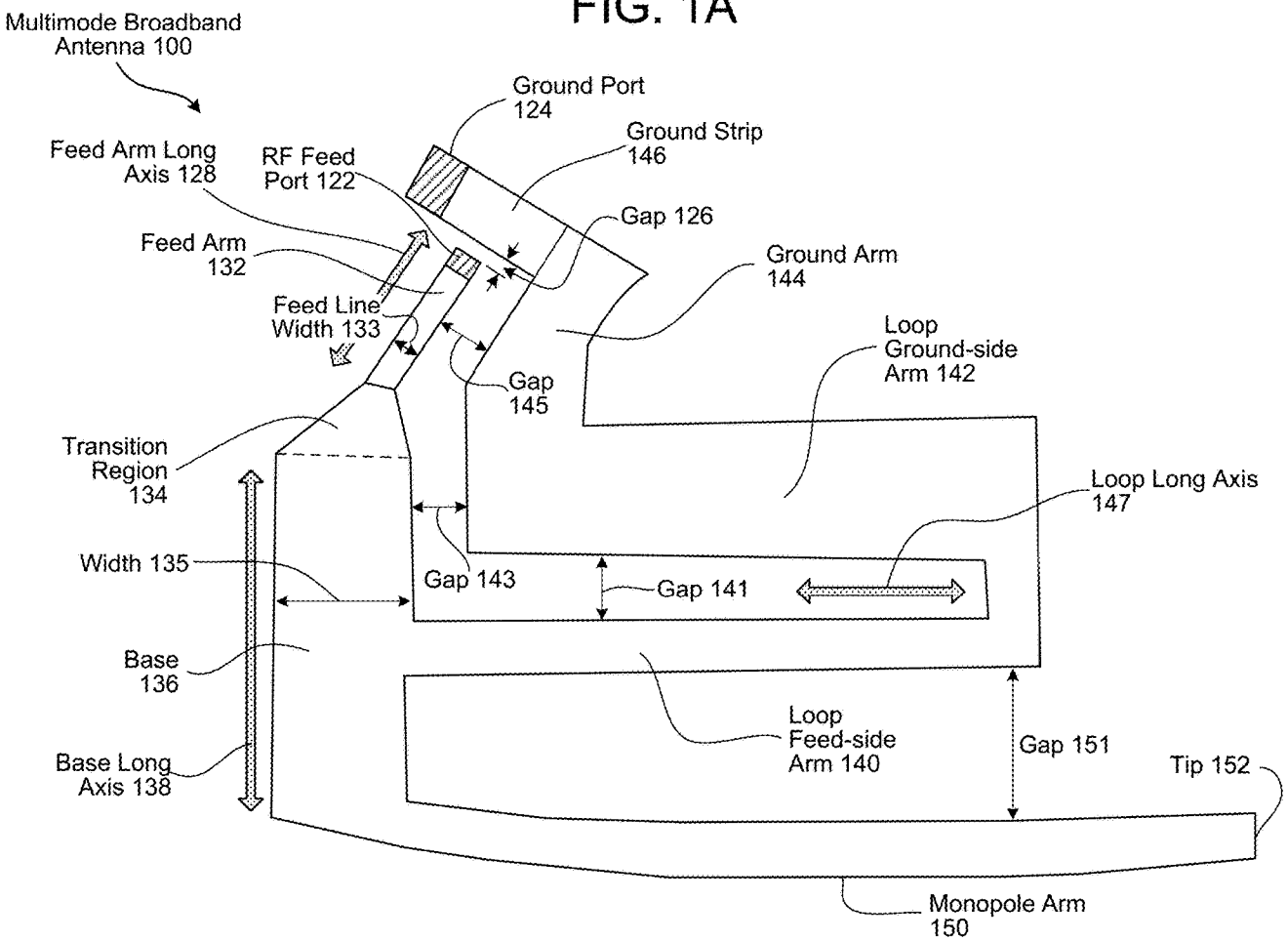
FIG. 1A illustrates a schematic outline for a multimode broadband antenna that supports co-located resonant modes for communications in the 2.4 GHz and 5 GHz WLAN bands.
Figure 1B:
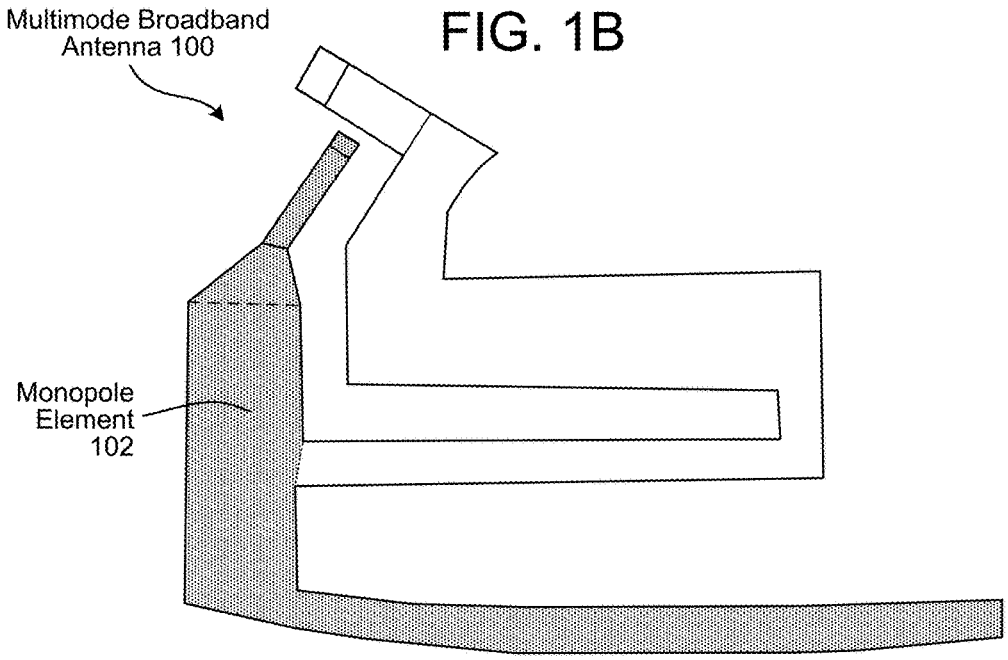
FIGS. 1B and 1C highlight the monopole and loop elements of the antenna in FIG. 1A.
Figure 1C:
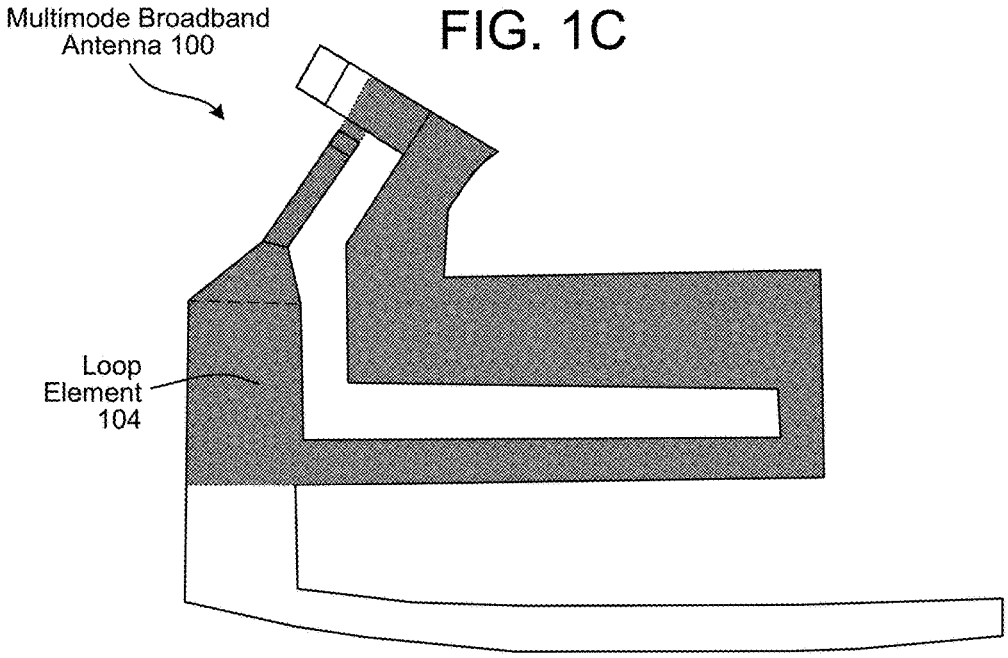

FIG. 1A illustrates a schematic outline of a compact multimode broadband antenna 100 that supports collocated resonances with very little destructive interference occurring between resonant oscillations. As highlighted in FIGS. 1B and 1C, the antenna 100 comprises a monopole element 102 and a folded loop element 104 that partially share structure, and are fed via a unitary RF feed port 122. A "monopole" antenna element is a single-element antenna fed at one end. A folded "loop" antenna element is an element where the one end is connected to an RF feed port, another end is connected to ground, and high frequency electromagnetic (EM) energy can couple across a gap between the ends. The antenna is well suited for simultaneous dual band WLAN (e.g., WiFi) applications in a low band and a high band, such as in the 2.4 GHz band (2.4 to 2.48 GHz) and the wide 5 GHz (5.15 to 5.85 GHz).

Resonance phenomena occur with various types of vibrations or waves. Applied electromagnetic (EM) radio frequency (RF) energy creates oscillations in an antenna element, with resonance creating one or more "standing waves." Each resonant structure is designed to combine added EM energy with energy reflected back down the structure to form a stationary RF wave where the EM peaks and troughs maintain a constant position. The frequency of the standing wave is a center frequency of the resonant mode.

The antenna 100 includes a monopole element 102 connected to the RF input 122, and a folded-loop element 104 that shares structure with the folded-loop element (i.e., is partially coextensive) before folding back toward the RF feed port 122. A ground port 124 of the antenna 100 is connected to the opposite end of the folded loop 104 from RF feed port 122, and the folded loop 104 include a gap 126 across which RF signals may couple when resonating around the loop in a full-wavelength resonance mode. Although the resonant modes are co-located in a shared structure, the modes do not interfere with each other, enabling simultaneous efficient operation at multiple frequencies across the supported portions of the radio spectrum.

The monopole element 102 comprises an RF feed arm 132 including the RF feed port 122, an elongated base 136 extending away from the feed arm 132, and an arm 150 ending at a tip 152. The arm extends away from the base 136 at an angle that is substantially perpendicular to a long axis 138 of the base 136.

The base 136 includes a transition region 134 that expands from a first width 133 to a second width 135. The narrower first width 133 that is approximately equal to a width of the feed arm 132 and to a width of an RF feed line (e.g., 132 in FIG. 3) coupled to the RF feed port 122. The wider second width 135 may be tuned to support resonances. However, the second width 135 being wider than the first width 133 is not critical to the design of the antenna 100, such that the first width 133 and second width 135 may be the same width.

The folded-loop element 104 includes an elongated loop. A portion of the loop element 104 is formed by the feed arm 132 and a section of the base 136, up to a mid-point where the monopole element 102 and folded-loop element 104 diverge. The elongated loop includes a first side and a second side oriented along a long axis 147 of the elongated loop (e.g., oriented substantially in parallel). The first side is part of a loop feed-side arm 140 which branches away from base 136 at the mid-point between the RF feed port 122 and the arm 150. The elongated loop folds away from the arm 150 and back toward the base 136 as the second side that is part of a loop ground-side arm 142. There is a gap 141 between the sides of the elongated loop.

Prior to reaching the base 136, the electrical conductor forming the loop 104 turns away from the base 136, labelled in FIG. 1 as the ground arm 144. A first portion of the loop ground-side arm 142/ground arm 144 extends in a direction substantially parallel to a long axis 138 of the base, separated from the base by a gap 143. A second portion of the ground arm 144 extends in a direction substantially parallel to a long axis 128 of the feed arm 132, separated from the feed arm 132 by a gap 145.

The ground arm 144 is connected to a ground strip 146 that extends in a direction substantially perpendicular to a long axis 128 of the feed arm 132, and connects to the ground port 124. The antenna feed line (e.g., 382 in FIG. 3) that couples the RF feed port 122 to an RF transceiver may pass below the ground strip 146. The ground strip 146 may be part of the same conductor that forms the ground arm 144 or may be separate. For example, the ground strip 146 may be an electrical conductive cladding layer or embedded layer of a substrate on which the antenna 100 is mounted and/or formed.

The ground strip 146 is separated from the RF feed port 122 by the gap 126 which forms part of the loop 104, as high frequency RF signals can couple across the gap 126. The distance across the gap 126 is smaller than the distance across the gaps 141, 143, and 145 that differentiate opposing sides of the loop element 104.

The monopole arm 150 extends in a direction away from the base 136 that is substantially parallel to the long axis 147 of the folded loop. The elongated section of the loop 104 and the monopole arm 150 are separate by a gap 151. The width of the gap 151 is a tunable feature that can be changed to alter RF coupling between the loop 104 and the monopole arm 150. As illustrated, the monopole arm 150 extends past an end of the elongated loop (where the loop folds back towards the base 136). However, the relative lengths of the elongated loop and the monopole arm 150 depends in part upon the width of the gap 151 and the frequencies at which the antenna 100 is configured to resonate.

The feed arm 132 is coupled to the transition region 134 of the base 136 at an obtuse angle. An angle may be used to help facilitate resonant coupling, and to slightly increase the difference between the longest and shortest distance along the conductor forming the folded loop element, thereby broadening the useable band(s). However, neither an obtuse angle nor the inclusion of the transition region 134 is a requirement. Also, although the feed arm 132 is illustrated as having a straight elongated structure, a curving structure may be instead be used.

A monolithic flat metal conductor forms at least the elongated base 136, the monopole arm 150, and the elongated section of the loop element 104 (i.e., arms 140 and 142). As is illustrated, the width of the electrical conductor varies at different points around the structure. These widths and the transitions between widths may be tuned to adjust the resonant properties of the antenna 100. As is generally understood in field of antenna design, the factors of total length and width are dependent on one another.

For operation as a WLAN antenna, the monopole element 102 is configured to provide a one-quarter wavelength resonant monopole mode at a first center frequency in the 2.4 GHz band. The monopole element is also configured to provide a three-quarters wavelength resonant monopole mode at a second center frequency in the 5 GHz band. The loop element 104 is configured to provide a two one-half wavelength resonant folded dipole mode at the second center frequency in the 5 GHz band.

The resonances in provided by the antenna 100 are cumulative, such that the various modes do not cancel each other out or appreciably attenuate each other (i.e., no substantial destructive interference between modes), with coupling between the monopole and folded dipole modes enhancing each other. This is in part due to the shared structure extending from the RF feed port 122 prior to the monopole element 102 and folded loop element 104 diverging at the midpoint, such that the resonances are complementary, in part due to the reduction in signal reflections from the folded loop element back into the feed arm 132. This can be seen in the current flow directions presented in the vector current distributions in FIGS. 4A, 5A, 6A, and 7A, as will be further discussed below.

Figure 2A:
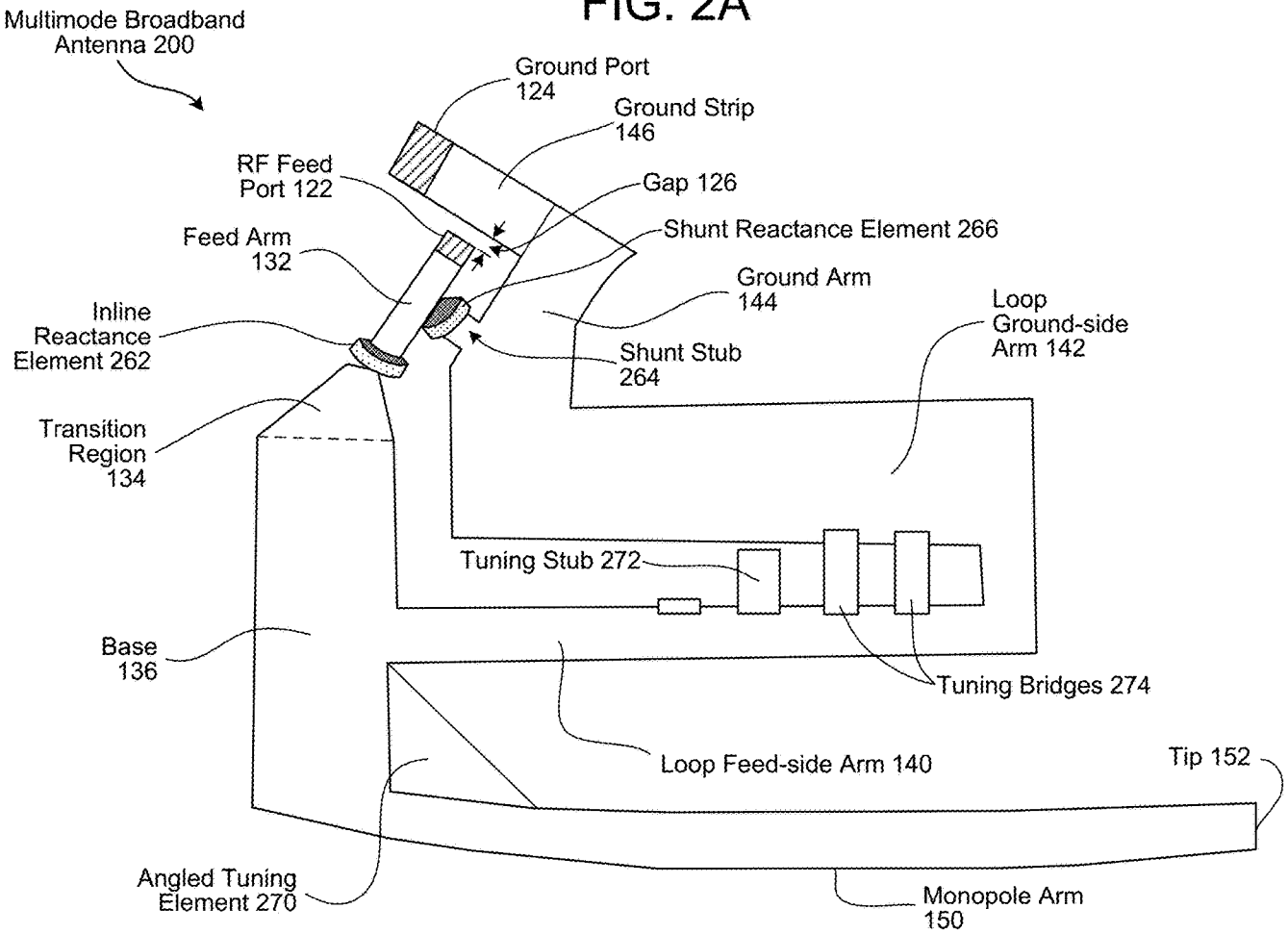
FIG. 2A illustrates a schematic outline for an example of the antenna in FIG. 1 tuned to support ultra-wideband communications.

FIG. 2A illustrates a schematic outline of a compact multimode broadband antenna 200 that includes added enhancements to the antenna 100 from FIG. 1. These optional enhancements optimize the antenna 200 to support ultra-wideband operations in addition to WLAN frequency bands.

One set of enhancement is the inclusion of reactive components within the antenna structure to facilitate frequency tuning. A first reactance element is an inline series capacitor or inductor 262 coupling the feed arm 132 and the transition region 134. Adjustments to the value of the capacitor or inductor 262 may be used to tune low frequency resonances. In the specific embodiment discussed below, the value of the series capacitor 262 is 12 pF. This reactive component may have a fixed reactance value or may be a tunable component, such as a tunable capacitor or a switchable inductor.

A second reactance element is shunt inductor or capacitor 266 that couple the ground arm 144 to the feed arm 132 across the gap 145. As illustrated, the shunt reactance element 266 is mounted at an end of a shunt stub 264 extending from the ground arm 144. The shunt reactance element 266 is used for impedance matching, and may either be an inductor or a capacitor. The second reactance element 266 may also have a fixed reactance value or may be a tunable component, such as a tunable capacitor, or switchable parallel inductors. Impedance matching of the elements is used to maximize the power transfer and reduce the energy lost to reflections not contributing to the resonances at the desired frequencies. In the specific embodiment, the shunt reactance element 266 is a 12 nH inductor.

Figure 2B:
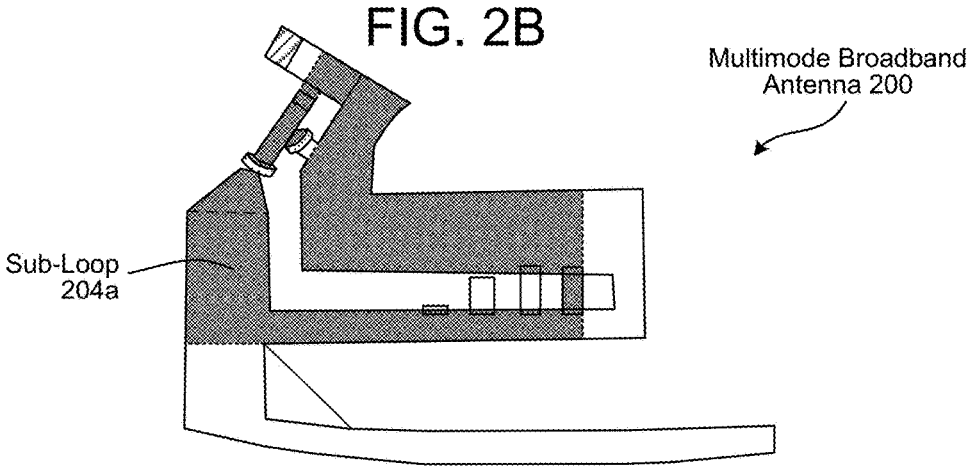
FIGS. 2B to 2D highlight sub-loops added to the loop element in FIG. 2A.
Figure 2C:
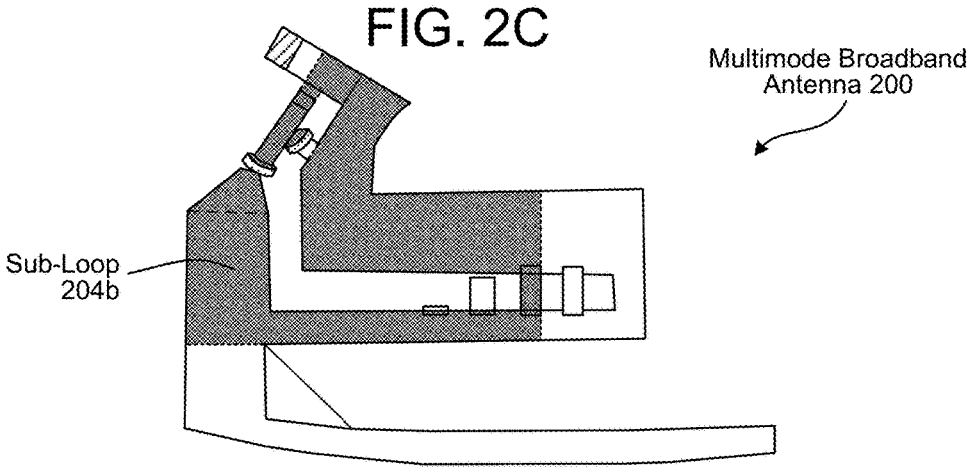

Another enhancement is the inclusion of tuning bridges 274 that cross the gap 141 of the elongated folded loop. Each tuning bridge 274 is an electrical conductor coupling the first side of the elongated loop to the second side elongated loop, thereby providing an alternative path for electrical current. These alternative paths are illustrated by the sub-loop 204*a* in FIG. 2B, and sub-loop 204*b* in FIG. 2C. These alternative paths provide a shorted distance around the folded loop for some current, such the tuning bridges 274 may be used to optimize the center frequencies at which resonance occurs in the folded loop element 104, and the range of frequencies at which at which the folded loop 104 element resonates.

Figure 2D:
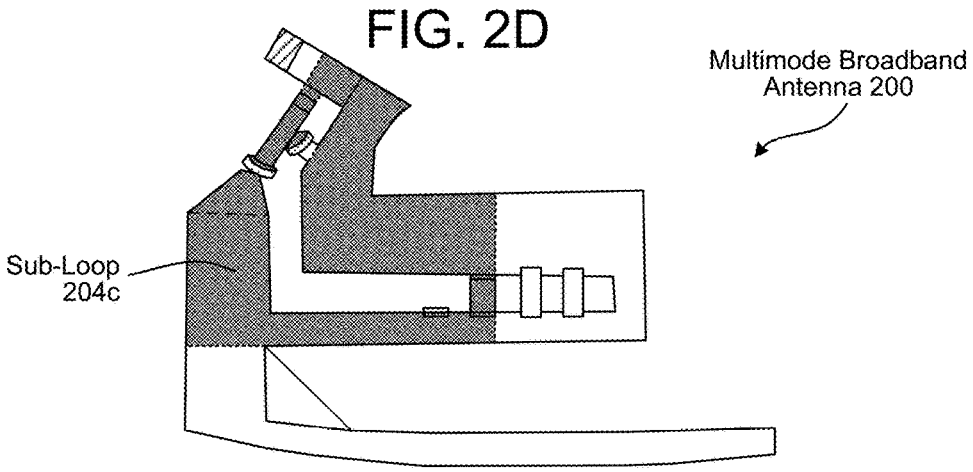

Also illustrated is a tuning stub 272 extending from the first side of the elongated loop into the gap 141, without connecting to the second side. As illustrated, stub 272 may be used to selectively couple high frequency RF signals from one side of the elongated folded loop to the other, thereby tuning resonance in the respective high frequencies. This higher-frequency, shorter-wavelength path is illustrated in FIG. 2D by sub-loop 204*c*.

Another enhancement is the angled tuning element 270 connected at a junction of the monopole arm 150 with the base 136. The angled tuning element 270 shortens the shortest-path distance from a tip 152 of the monopole element 102 to the RF feed port 122, thereby broadening a range of frequencies at which the monopole element 102 resonates.

Figure 3:
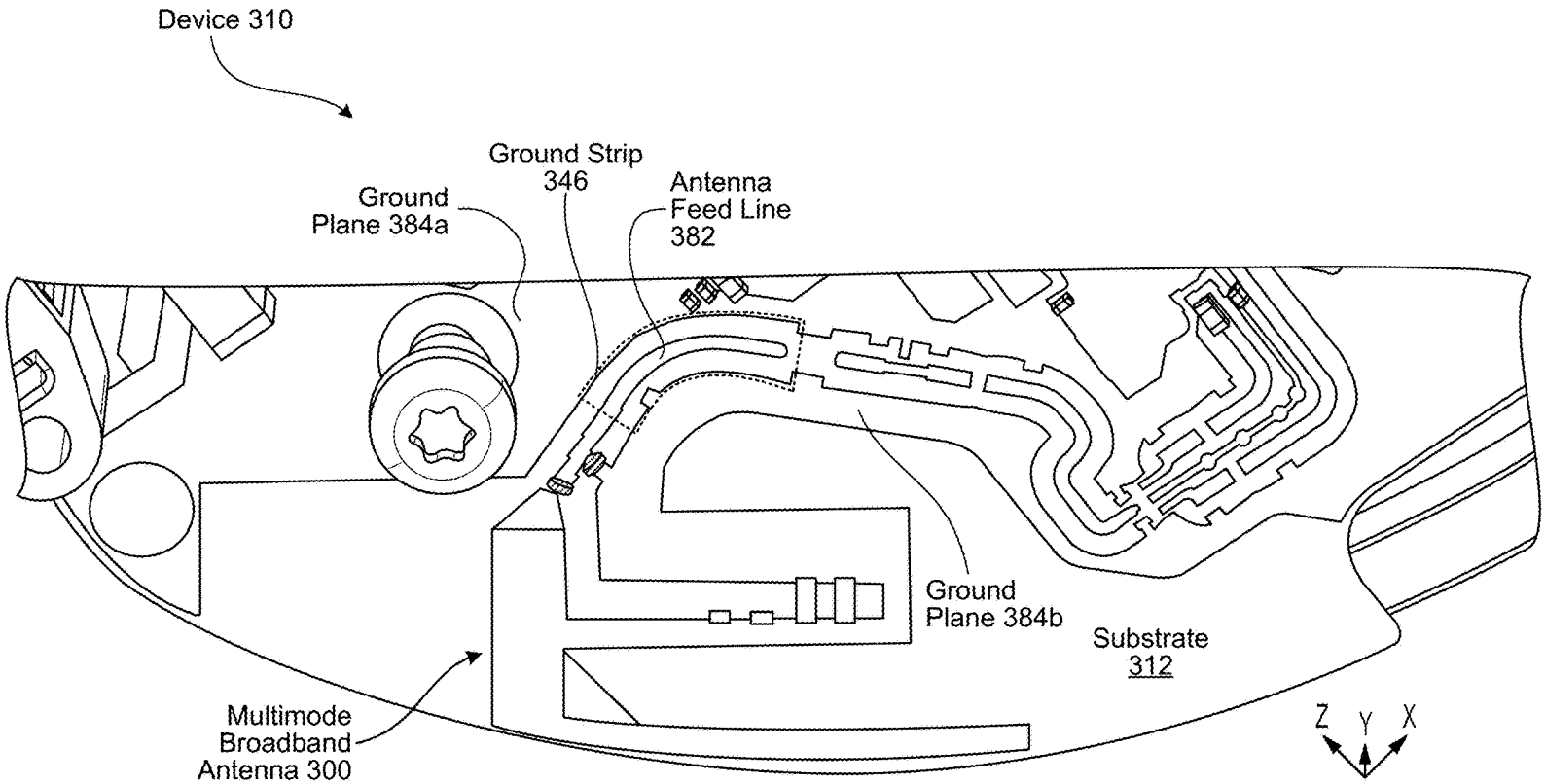
FIG. 3 illustrates an antenna based on the outline in FIG. 2 arranged in a device structure.

FIG. 3 is an embodiment of an antenna 300 based on the antenna 200 in FIG. 2 arranged in a device 310. Although the ground strip 146 may be used as illustrated in FIGS. 1A and 2A, as will be used in simulations presented in FIGS. 4A to 9, FIG. 3 illustrates an extended ground strip 346 that bridges underneath the antenna feed line 382 through an electrically non-conductive substrate 312. The multimode antenna 300 may be disposed on a two or three-dimensional surface of the electrically non-conductive substrate 312 such as a dielectric carrier, with the RF signals that couple between the feed arm 132 and the ground strip 346 coupling through the substrate 312 (e.g., the gap 126 comprising a thickness of the substrate 312. Examples of non-conductive substrate include a circuit board, such as a printed circuit board (PCB), a non-conductive plastic, glass, a metal-doped laser-activated thermoplastic (as may be used with laser direct structuring (LDS)), etc. Within the device 310, the antenna 300 is positioned so that the resonant elements do not come into contact with other electrically conductive components besides the connection of the antenna 300 to the antenna feed line 382, and the connection of the ground strip 346 to the device's ground plane (e.g., 384*a*/384*b*).

In operation, the antenna structure meets electromagnetic (EM) boundary conditions at particular resonant frequencies where the electric currents created along the antenna 100/200/300 by applied RF energy change amplitude and direction. Typically at the antenna structure's open end, its current drops to minimum, whilst at the feed point, its current reaches its maximum. At these locations where the overall current drops to a relative minimum value, the electric field is at a local maximum (e.g., at the antenna's open end). At other locations which could be a quarter or multiples-of-a-quarter wavelengths apart, the overall electric field drops to a relative minimum value, whereas the current is at a local maximum (e.g., at the antenna feed). Coupling between such current minimums/electric field maximums and the RF feed port 122 may correspond to resonance. Resonant couplings may also occur between current minimums/electric field maximums.

Figure 4A:
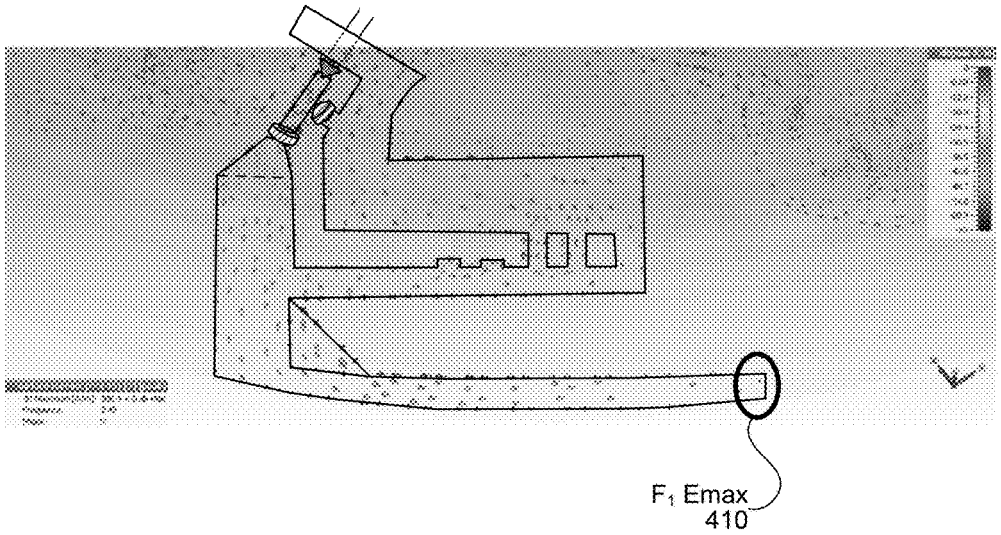
FIGS. 4A and 4B illustrate currents and resonance at 2.45 GHz.
Figure 4B:
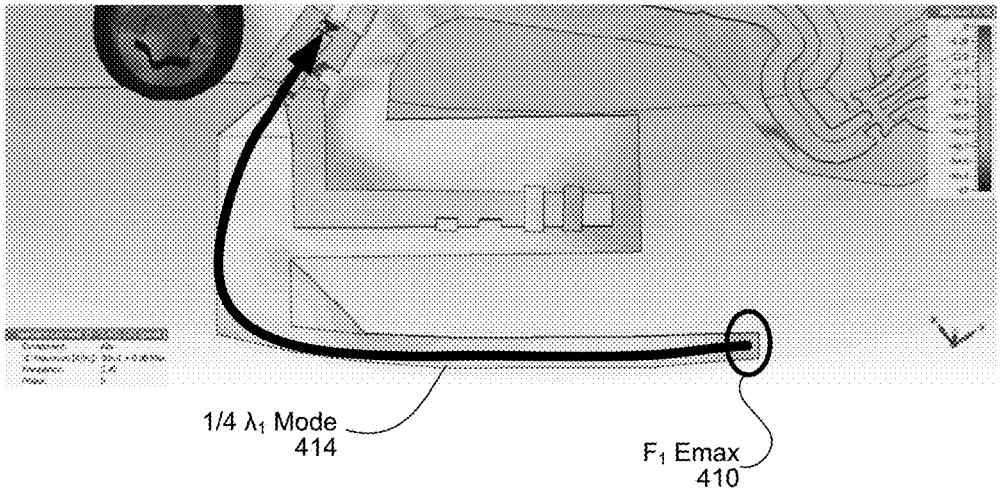

FIG. 4A illustrates a vector current distribution and FIG. 4B illustrates an absolute amplitude current distribution at 2.45 GHz in the device structure based on the antenna 300 of FIG. 3. Referring to FIG. 4A, the antenna structure meets an EM boundary condition at 2.45 GHz at the tip 152 of the monopole element, where a local maximum occurs in the electric field ("Emax") 410. As approximated by the arrow annotation in FIG. 4B, a one-quarter wavelength (¼ $\lambda_1$) monopole mode resonance 414 is created along the monopole element at 2.45 GHz ($F_1$) between the tip 152 of the monopole element 102 and the RF feed port 122.

Figure 5A:
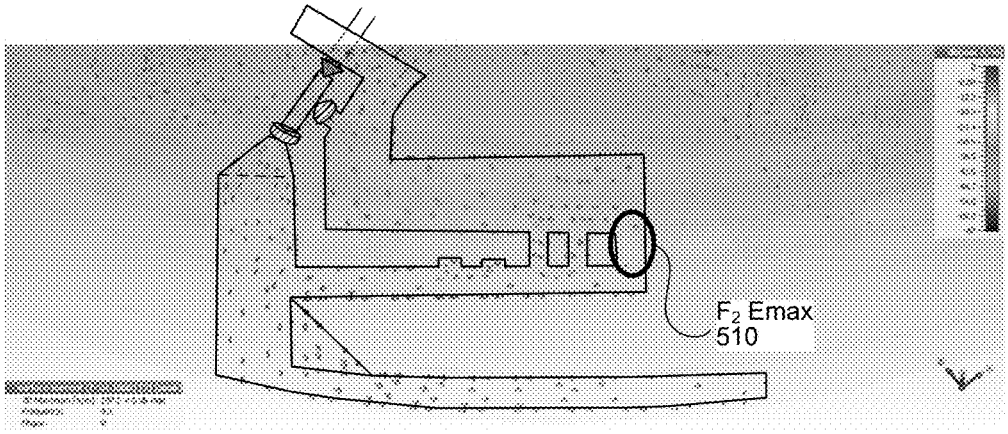
FIGS. 5A and 5B illustrate currents and resonances at 4.1 GHz.
Figure 5B:
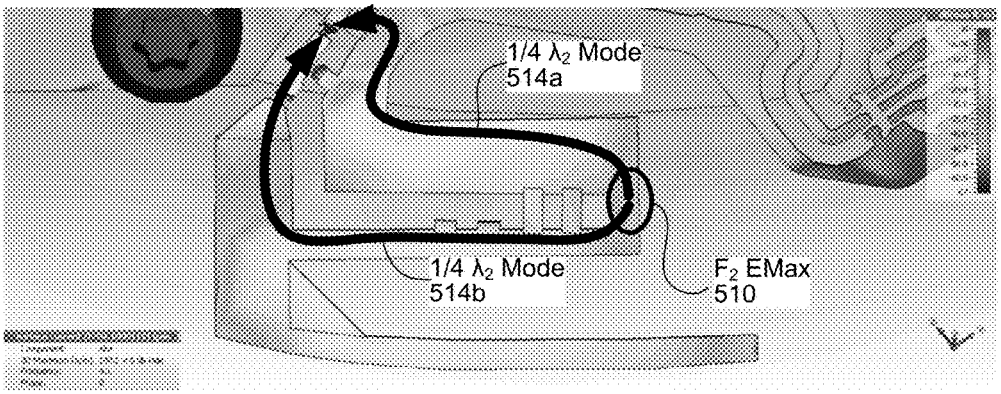

FIG. 5A illustrates a vector current distribution and FIG. 5B illustrates an absolute amplitude current distribution at 4.1 GHz in the device structure based on the antenna 300 in FIG. 3. Referring to FIG. 5A, the antenna structure meets an EM boundary condition at 4.1 GHz proximate to the elongated loop folds back toward the base 136, where a local maximum occurs (Emax 510) in the electric field. As approximated by the arrow annotations in FIG. 5B, two one-quarter (¼ $\lambda_2$) wavelength folded monopole modes 514*a* and 514*b* provide resonance along the folded loop element at 4.1 GHz ($F_2$) between the Emax boundary condition 510 and the RF feed port 122. Effectively, this creates a one-half (½ $\lambda_2$) wavelength folded dipole mode around the loop element 104.

Figure 6A:
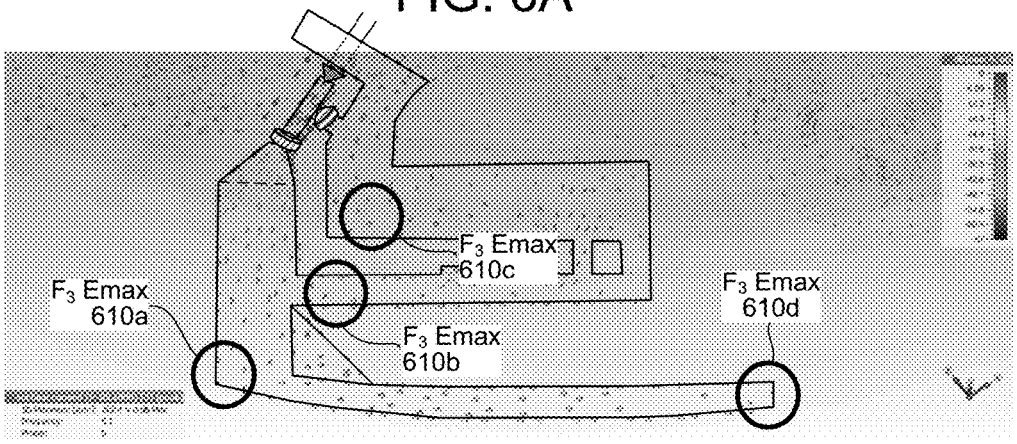
FIGS. 6A to 6C illustrate currents and resonances at 5.1 GHz.
Figure 6B:
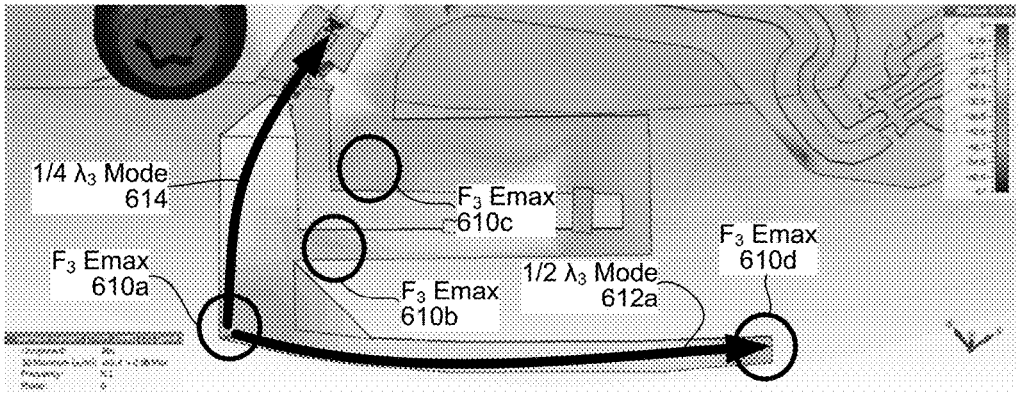
Figure 6C:
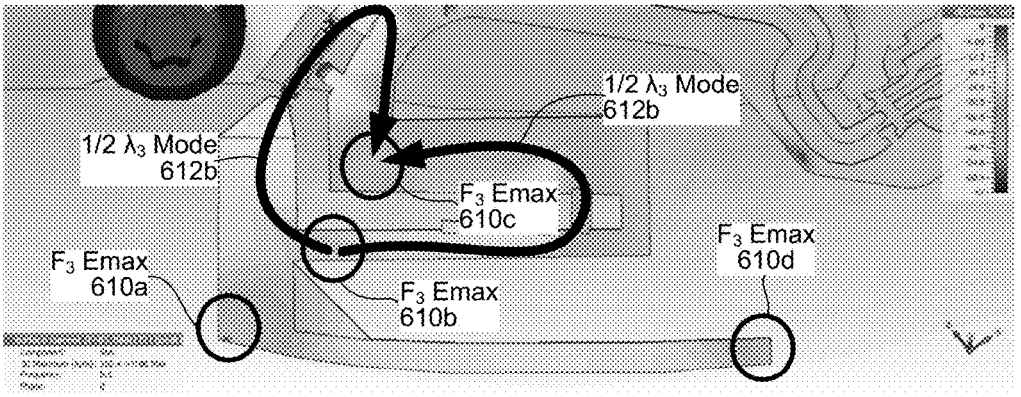

FIG. 6A illustrates a vector current distribution and FIGS. 6B and 6C illustrate absolute amplitude current distributions at 5.1 GHz in the device structure based on the antenna 300 in FIG. 3. Referring to FIG. 6A, the antenna structure meets an EM boundary condition at 5.1 GHz proximate to an outer corner where the base 136 transitions into the monopole arm 150, where a local maximum (Emax 610*a*) occurs in the electric field. The antenna structure also meets an EM boundary condition at 5.1 GHz along the feed-side arm 140 near the base 136, where a local maximum (Emax 160*b*) occurs in the electric field, and along the loop ground-side arm 142, on an opposite side of the gap 141, where another local maximum (Emax 160*c*) occurs in the electric field.

As approximated by the arrow annotations in FIG. 6B, a one-quarter wavelength (¼ $\lambda_3$) monopole mode resonance 614 is created along the monopole element 102 at 5.1 GHz ($F_3$) between the Emax boundary condition 610*a* and the feed port 122. A one-half wavelength (½ $\lambda_3$) dipole mode resonance 612*a* is created along the monopole element 102 at 5.1 GHz (F3) between the Emax boundary condition 610*a* and the tip 152 of the monopole arm 150 (Emax 610*d*). Combined, these two resonances act as a three-quarters monopole mode (i.e., ¾ $\lambda_3$) along the monopole element 102.

As approximated by the arrow annotations in FIG. 6C, two one-half wavelength (½ $\lambda_3$) folded dipole modes 612*b* and 612*c* provide resonance along the loop element sub-loop 204*a* at 5.1 GHz ($F_3$) between the Emax boundary condition 610*b*, and the Emax boundary condition 610*c*. Combined, these two half-wavelength resonances act as a one-wavelength folded dipole mode (i.e., 2×½ $\lambda_3$ for a combined resonance of 1×$\lambda_3$) around the sub-loop 204*a* along the electrical conductor(s) and across the gap 126.

Figure 7A:
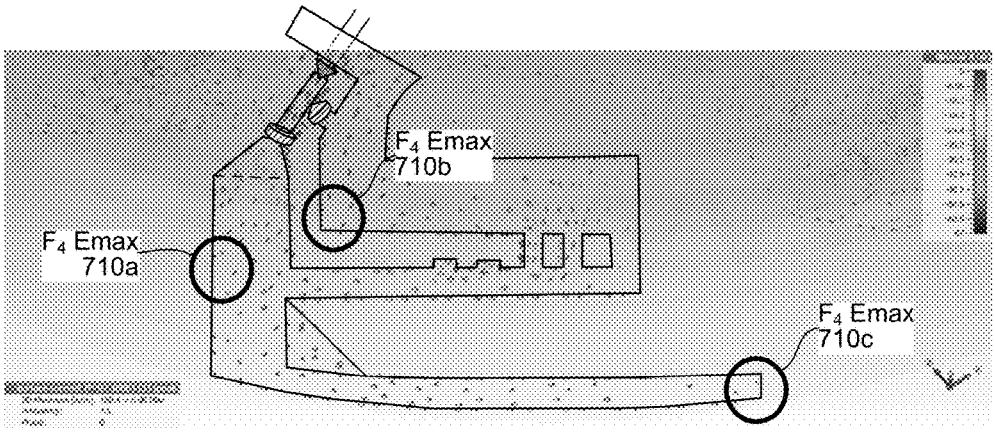
FIGS. 7A to 7C illustrate currents and resonances at 7.1 GHz.
Figure 7B:
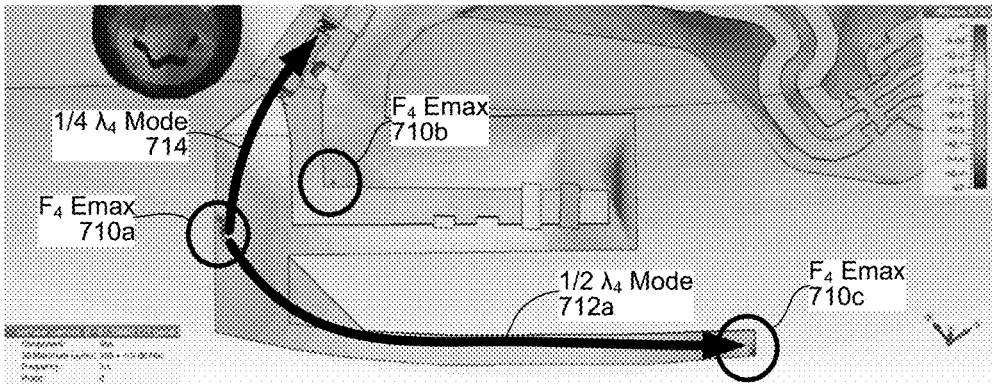
Figure 7C:
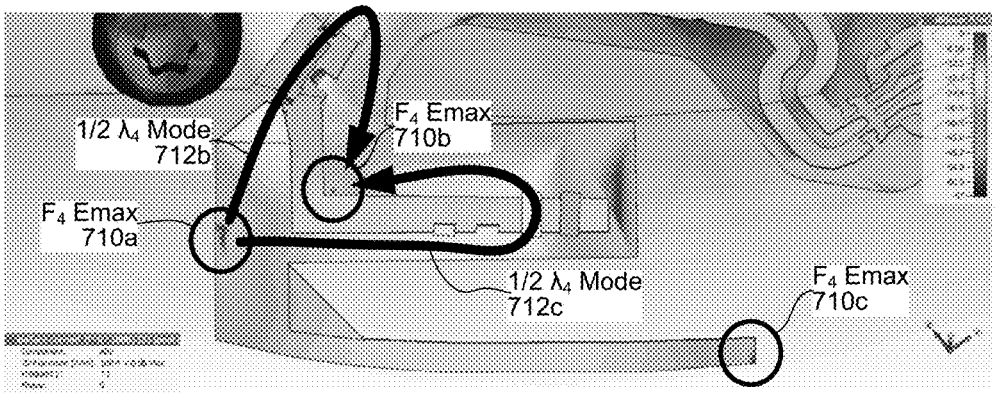

FIG. 7A illustrates a vector current distribution and FIGS. 7B and 7C illustrate absolute amplitude current distributions at 7.1 GHz in the device structure based on the antenna 300 in FIG. 3. Referring to FIG. 7A, the antenna structure meets the EM boundary condition at 7.1 GHz proximate to an edge of the base 136 near the midpoint where the monopole element 102 and the loop element 104 diverge, where a local maximum (Emax 710*a*) occurs in the electric field. The antenna structure also meets a local maximum (Emax 710*b*) near an inside corner where the loop ground-side arm 142 transitions into the ground arm 144.

As illustrated in FIG. 7B, a one-quarter wavelength (¼ $\lambda_4$) monopole mode resonance 714 is created along the monopole element 102 at 7.1 GHz ($F_4$) between the Emax boundary condition 710*a* and the RF feed port 122. A one-half wavelength (½ $\lambda_4$) monopole dipole mode resonance 712*a* is created in the monopole element 102 at 7.1 GHz ($F_4$) between the Emax boundary condition 710*a* and the tip 152 of the monopole arm 150 (Emax 710*c*). Combined, these two resonances act as a three-quarters monopole mode (i.e., ¾ $\lambda_4$).

As illustrated in FIG. 7C, two one-half wavelength (½ $\lambda_4$) folded dipole modes 712*b* and 712*c* provide resonance along the loop element sub-loop 204*b* at 7.1 GHz ($F_4$), between the Emax boundary condition 710*a* and the Emax boundary condition 710*b*. Combined, these two half-wavelength resonances act as a one-wavelength folded dipole mode (i.e., 2×½ $\lambda_4$ for a combined resonance of 1×$\lambda_4$) travelling around the sub-loop 204*b* along the electrical conductor(s) and across the gap 126.

It should be noted that in FIGS. 4 to 7 the distance along one mode path may appear to be longer or shorter than an identical mode along a different path. While this is in part due to illustrated paths not being exact, if exact paths were calculated, the distances would in most cases would still be different. This is due to differences in capacitive and inductive loading between pathways, which alter the distance along each current path corresponding to resonance.

Figure 8:
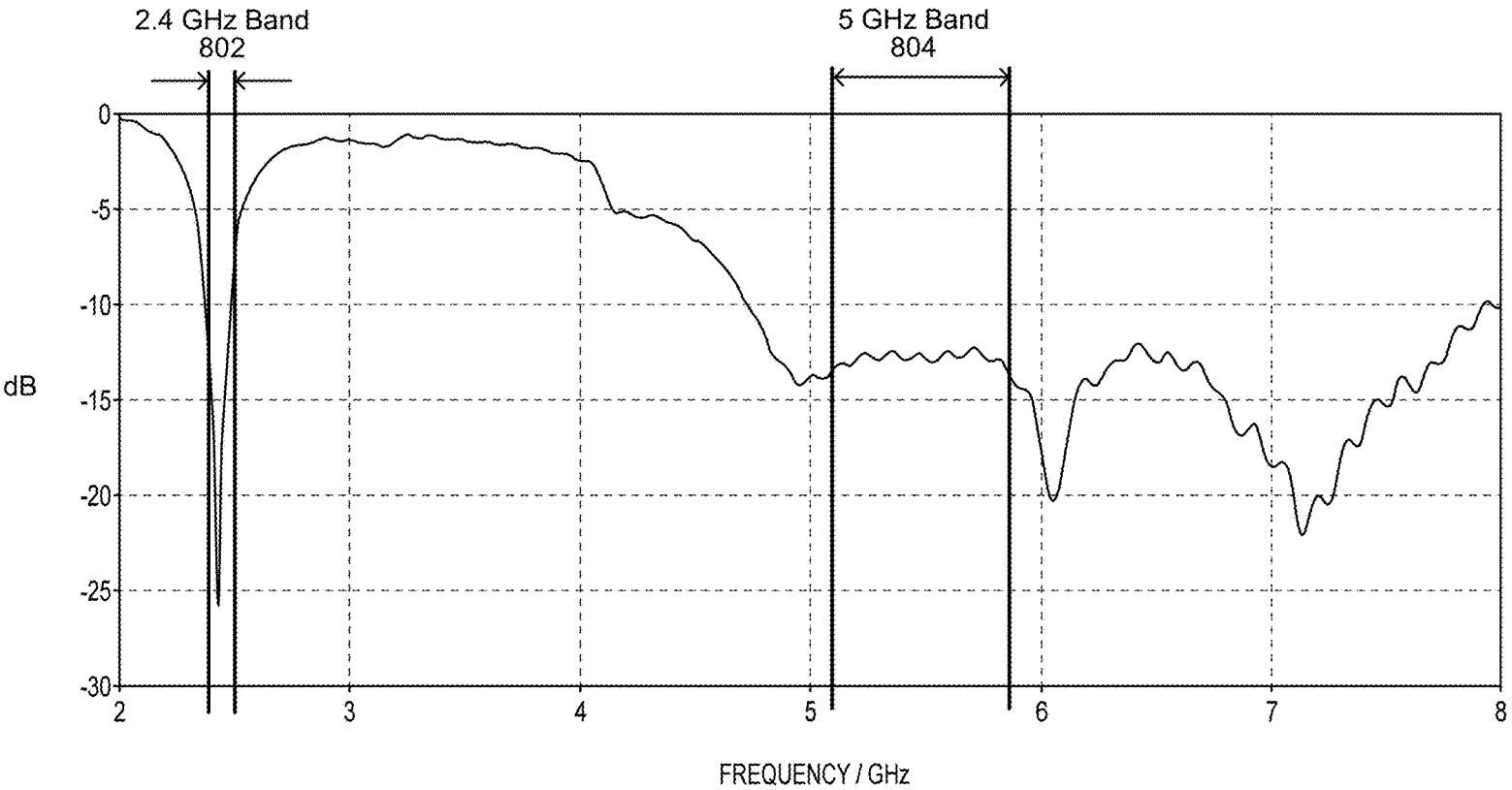
FIG. 8 is a scattering parameter (S-parameter) chart illustrating performance characteristics.

FIG. 8 is a scattering parameter (S-parameter) in decibels (dB) chart illustrating performance characteristics of an antenna in the device structure used to model the currents in FIGS. 4A to 7C, highlighting the 2.4 GHz band 802 and the 5 GHz band 804. The troughs in the S-parameter characteristics of the antenna demonstrate resonance in the antenna structure. For example, in FIG. 8, distinct resonance troughs occur at approximately 2.4 GHz, 4.1 GHz, 5.0 GHz, 6.1 GHz, and 7.1 GHz.

Figure 9:
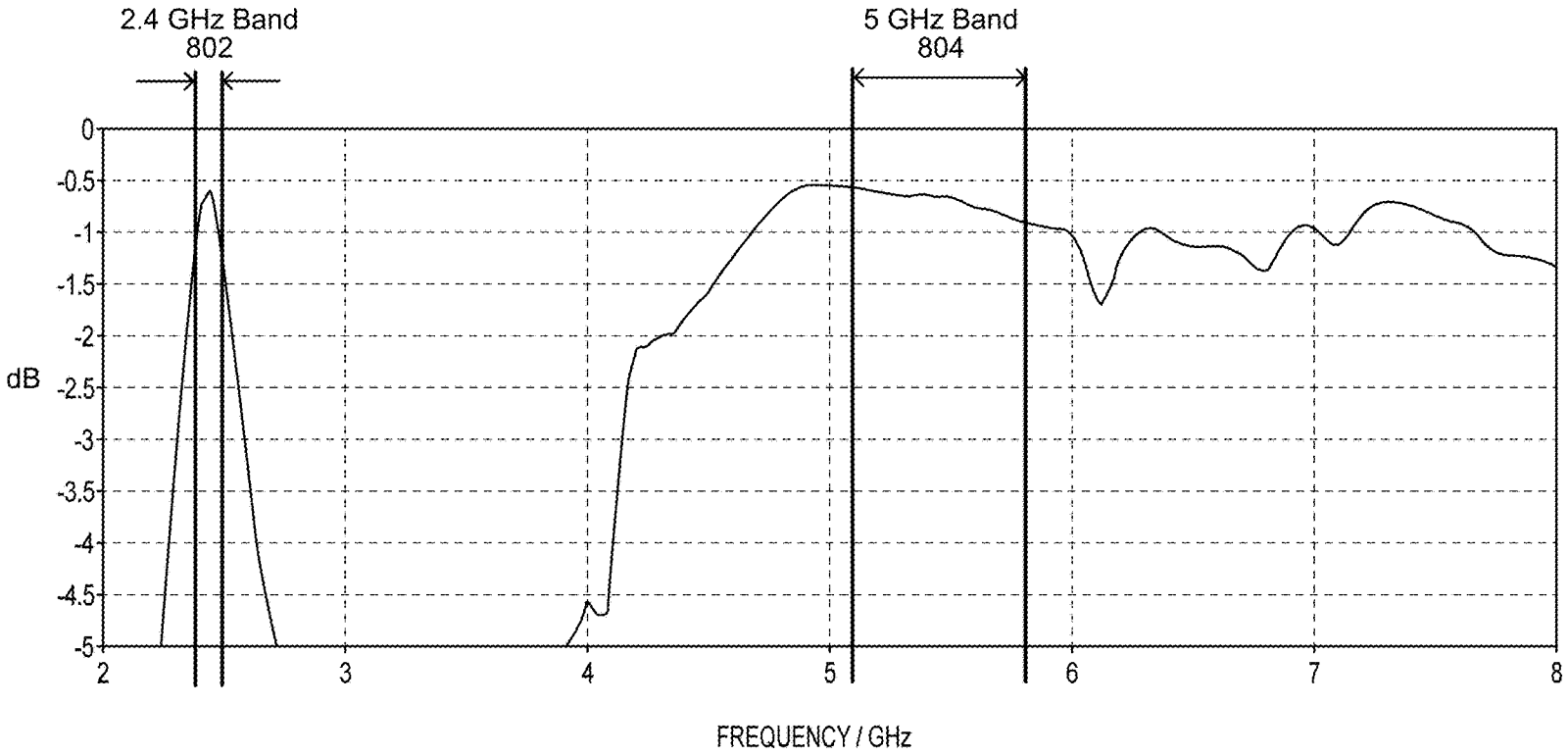
FIG. 9 illustrates the total system efficiency of the antenna.

FIG. 9 illustrates the total system efficiency of the antenna in the device structure used to model the currents in FIGS. 4A to 7C. As illustrated in FIG. 9, in addition to resonance in the 2.4 GHz Band 802, it can be seen that the antenna supports continuous resonance from the trough at 4.2 GHz (referring to FIG. 8) to 8 GHz, with more than a 3.5 GHz range exhibiting a total system efficiency better than −2 dB. Although the illustration ends at 8 GHz, performance of this embodiment of the antenna is believed to be suitable for ultra-wideband applications in a frequency range from around 4.5 GHz to approximately 10 GHz, spanning most of the approved ultra-wideband spectrum. With further optimization, the usable ultra-wideband spectrum could be shifted downward from 4.5 GHz to 3.1 GHz, and/or the frequency range of efficient operation might be further expanded to support an entirety of the ultra-wideband spectrum (3.1 to 10.6 GHz in the United States).

Figure 10:
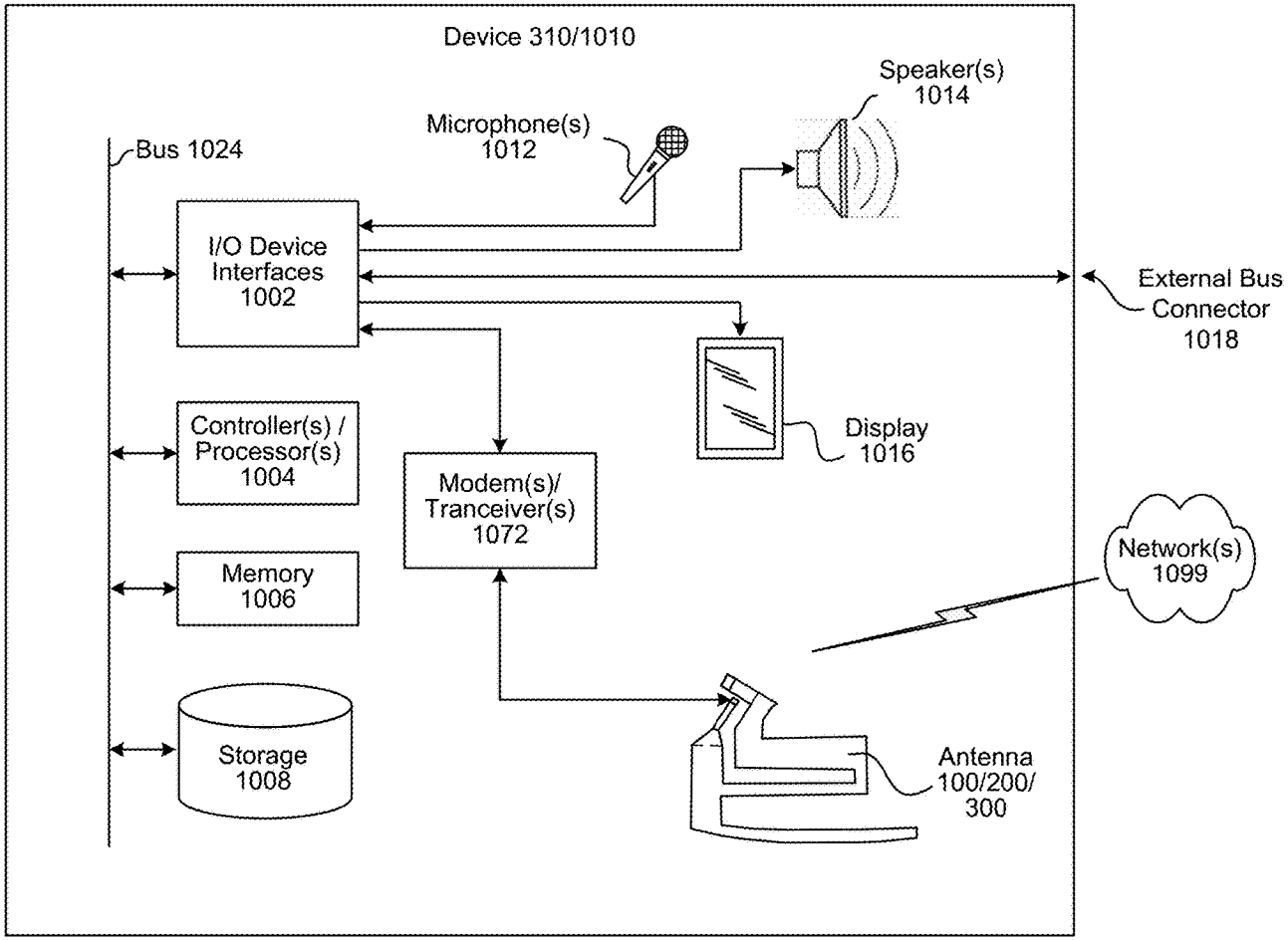
FIG. 10 is a block diagram conceptually illustrating a device including at least one of the antennae from FIGS. 1, 2, and 3.

FIG. 10 is a block diagram conceptually illustrating a device 310/1010 including at least one of the antennae 100/200/300. Various components within the device 310/1010 may be connected via one or more data busses 1024, although the components may also or instead be connected to each other directly. The device 310/1010 may include controller(s)/processor(s) 1004 that may each include one or more central processing units (CPUs) for processing data and computer-readable instructions, and a memory 1006 for storing data and instructions.

The memory 1006 may include volatile random access memory (RAM), non-volatile read only memory (ROM), and/or other types of memory. The device 310/1010 may also include a non-transitory data storage component 1008, for storing data and instructions. The data storage component 1008 may include one or more storage types such as magnetic storage, optical storage, solid-state storage, etc. The device 310/1010 may also be connected to removable or external memory and/or storage (such as a removable memory card, memory key drive, networked storage, etc.) through an external bus connector 1018.

Computer instructions for processing by the controller(s)/processor(s) 1004 for operating the device 310/1010 and its various components may be executed by the controller/processor 1004 and stored in the memory 1006, storage 1008, or an external device. Alternatively, some or all of the executable instructions may be embedded in hardware or firmware in addition to or instead of software.

The device 310/1010 may communicate with a variety of input/output components through input/output (I/O) device interfaces 1002. Examples of input/output components that may be included include microphone(s) 1012, speaker(s) 1014, a display 1016, and one or more modems and/or RF transceivers 1072. The I/O device interfaces 1002 may also provide access to one or more external bus connectors 1018 (e.g., a universal serial bus (USB) port), and receive data from a touch interface included with display 1016 or other user interfaces. Some or all of these components may be omitted, and additional components not included in FIG. 10 may be added.

Modem(s)/transceiver(s) 1072 are connected to the one or more of antennae 100/200/300, and may support a variety of wireless communication protocols. For example, the modem(s)/transceiver(s) 1072 may support 4G wireless protocols such as LTE, LTE Advanced, and WiMax, 3G wireless protocols such as GSM (Global System for Mobile Communications), CDMA (code division multiple access), and WCDMA (wideband code division multiple access), short-range connectivity protocols such as Bluetooth, wireless local area network (WLAN) connectivity (such as IEEE 802.11 WiFi), and high-bandwidth short-range ultra-wideband. The modem(s)/RF transceiver(s) 1072 are connected to the RF feed port 122 of the antenna 100/200/300, as well as to the ground port 124 and ground planes (e.g., 384*a*/

384*b*). In the various examples, the antenna 100/200 is driven by the single RF feed port 122 to generate at least two resonant modes.

The antennae 100/200/300 may be constructed from one or more flat metal conductors. The conductors may be cut or etched from metal sheeting in the conventional manner, deposited or plated onto the substrate, etched from cladding layers formed on one or both sides of a substrate, or activated from metal-plastic additives included in the substrate. If metal sheeting is used, it may be standard sheeting commonly used for existing mobile device antennae, such as sheeting having a thickness of around 10 to 20 microns, although different thickness material may be used. Similar thickness may be used if the antenna is formed by other methods.

Among other antenna fabrications methods, laser direct structuring (LDS) may be used. The LDS process uses a thermoplastic material, doped with a metal additive activated by means of laser. The substrate may be single-component injection molded and can be used to create complex antenna and circuit layouts on a three-dimensional carrier structure. A laser writes the course of the antenna and circuit traces on the plastic. Where the laser beam hits the plastic, the metal additive forms a micro-rough track. The metal particles of this track form the nuclei for subsequent metallization. Placed in an electroless copper bath, the conductor path layers arise precisely on these tracks. Successively layers of copper, nickel, gold, tin, etc., may be raised in this way.

The device 310/1010 may be configured to support a variety of wireless applications, such as the wireless downloading of media via the antennae and modem(s)/transceivers(s) 1072, the storage of the downloaded media in memory 1006 and/or storage 1006, and the playback of the media by controller(s)/processor(s) 1004. Examples of downloaded media include digital video (e.g., movies, television, short clips, etc.), images (e.g., art, photographs, etc.), and multimedia content. The device 310/1010 may stream such visual media to an external display via the antenna 100/200/300.

As noted above in the discussion of substrates, the antennae described herein may be implemented with two-dimensional geometries, as well as three-dimensional geometries. Also, the frequency bands used in the example antennae are included for the purpose of demonstration, and by changing the dimensions of the various elements, different bands may be supported. Also, additional resonant elements may be added. For example, another monopole arm may be extended from the base 136.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art.

As used in this disclosure, the term "a" or "one" may include one or more items unless specifically stated otherwise.

What is claimed is:

1. A multi-band antenna structure, comprising:

a radio frequency (RF) feed port;

a ground port;

an antenna comprising a monopole element and a loop element, the loop element including a section of the monopole element, the monopole element comprising:

a feed arm extending in a first direction from the RF feed port, a proximal end of the feed arm including the RF feed port;

a base portion extending away from the feed arm in a second direction, a distal end of the feed arm opposite the RF feed port coupled to a proximal end of the base portion, the feed arm having a first width and the proximal end of the base portion including a transition region that gradually expands from the first width to a second width; and a monopole arm extending from a distal end of the base portion, opposite the feed arm, in a third direction that is substantially perpendicular to the second direction, the folded loop element comprising:

the feed arm;

the base portion from the proximal end coupled to the feed arm to a mid-point region of the base portion;

a feed-side arm, coupled at a proximal end to the mid-point region and extending laterally from the base portion in substantially the third direction;

a ground-side arm, a proximal end of the ground-side arm connected to a distal end of the feed-side arm and extending in a fourth direction substantially opposite to the third direction, there being a first gap between the feed-side arm and the ground-side arm;

a ground arm comprising:

a first segment extending from a distal end of the feed side-arm in fifth direction substantially opposite to the second direction, there being a second gap between the first segment and the based portion; and a second segment extending from the first segment in a sixth direction substantially opposite to the first direction, there being a third gap between the second segment and the feed arm;

a ground strip extending from the second segment in a seventh direction substantially perpendicular to the sixth direction, the ground strip traversing a long axis of the feed arm proximate to the RF feed port to the ground port; and a fourth gap separating the ground strip from the RF feed port, a distance across the fourth gap being less than each of the distances across the first gap, the second gap, and the third gap.

2. The multi-band antenna structure of claim 1, wherein a monolithic flat metal conductor forms at least the base portion, the monopole arm, the feed-side arm, the ground-side arm, and the ground arm, and a first distance along the monopole element from the RF feed port to a tip of the monopole arm, opposite the base portion, is configured for resonance in a one-quarter wavelength monopole mode in a 2.4 GHz WLAN band, a second distance along the monopole element from the RF feed port to the tip of the monopole arm, opposite the base portion, is configured for resonance in a three-quarters wavelength monopole mode in a 5 GHz WLAN band, and a third distance along and around the loop element, including crossing the fourth gap, is configured for resonance in a single wavelength folded dipole mode in the 5 GHz WLAN band.

3. The multi-band antenna structure of claim 2, further configured for resonance across a range of frequencies from a first frequency that is below the 5 GHz WLAN band, to a second frequency that is above the 5 GHz WLAN band, wherein a fourth distance along and around the loop element, including crossing the fourth gap, is configured for resonance in a one-half wavelength folded dipole mode at the first frequency, and a fifth distance along and around the folded-loop antenna, including crossing the fourth gap, is configured for resonance in a single wavelength folded dipole mode at the second frequency.

4. A wireless communication device comprising:

a radio transceiver;

a processor communicatively coupled to the radio transceiver; and an antenna comprising:

a radio frequency (RF) input, coupled to the radio transceiver;

a monopole element connected to the RF input; and a loop element connected at a first end to the RF input and at a second end to ground, the loop element partially coextensive with the monopole element and including a gap between the RF input and the second end, wherein the monopole element comprises an elongated base and an arm, the arm extending at an angle from the elongated base opposite the RF input.

5. The wireless communication device of claim 4, wherein the loop element comprises a first side and a second side, the first side extending away from a mid-point of the elongated base between the RF input and the arm to connect to the second side, the second side extending back toward and coupled to ground, the arm of the monopole element being substantially parallel to the first side and the second side of the loop element.

6. The wireless communication device of claim 5, wherein a section of the elongated base shared by the monopole element and the loop element comprises a transition region that expands from a first width that is approximately equal to a width of the RF input, to a second width.

7. The wireless communication device of claim 5, further comprising an electrical conductor coupling the first side of the loop element to the second side loop element, providing an alternative path for electrical current, such that a first portion of energy applied to the RF input by the radio transceiver travels a first distance around the loop element, and a second portion of the energy travels a second distance that is shorter than the first distance via the electrical conductor.

8. The wireless communication device of claim 5, wherein at least the elongated base, the arm, the first side, and the second side are formed of a monolithic flat metal material.

9. The wireless communication device of claim 4, the antenna further comprising:

an inline reactance element included in series between the RF input and the elongated base, tuning resonance of the antenna; and a shunt reactance element coupling the second side of the loop element to the RF input, further tuning resonance of the antenna.

10. The wireless communication device of claim 4, wherein the monopole element is configured to:

provide a one-quarter wavelength resonant monopole mode at a first center frequency, and provide a three-quarters wavelength resonant monopole mode at a second center frequency, the second center frequency being higher than the first center frequency, and the loop element is configured to:

provide a single wavelength resonant folded dipole mode at the second center frequency.

11. The wireless communication device of claim 10, wherein the first center frequency is within a first range of 2.40 to 2.48 GHz and the second center frequency is within second range of 5.15 to 5.85 GHz, and the loop element is further configured to provide a half wavelength resonant folded dipole mode at a third center frequency, and to provide a single wavelength resonant folded dipole mode at a fourth center frequency, wherein the third center frequency and the fourth center frequency are in a range between 3.1 GHz and 10.6 GHz, the third center frequency being less than the second center frequency and the fourth center frequency being greater than the second center frequency.

12. The wireless communication device of claim 11, further comprising:

an electrical conductor coupling the first side of the loop element to the second side loop element, providing an alternative path for electrical current, wherein the half wavelength resonant folded dipole mode at the third center frequency travels a first distance around the loop element, and the single wavelength resonant folded dipole mode at the fourth center frequency travels a second distance around the loop element via the electrical conductor, the second distance being shorter than the first distance.

13. The wireless communication device of claim 11, wherein a difference between the third center frequency and the fourth center frequency is at least 3 GHz and the antenna is configured to provide resonance at any frequency between the third center frequency and the fourth center frequency.

14. An antenna structure comprising:

a radio frequency (RF) port;

a ground port;

a monopole element connected to the RF port; and a loop element connected at a first end to the RF port and at a second end to the ground port, the loop element partially coextensive with the monopole element and including a gap between the RF port and the ground port, wherein the monopole element comprises an elongated base and an arm, the arm extending at an angle from the elongated base opposite the RF port.

15. The antenna structure of claim 14, wherein the loop element comprises a first side and a second side, the first side extending away from a mid-point of the elongated base between the RF port and the arm to connect to the second side, the second side extending back toward and coupled to the ground port, the arm of the monopole element being substantially parallel to the first side and the second side of the loop element.

16. The antenna structure of claim 15, wherein a section of the elongated base shared by the monopole element and the loop element comprises a transition region that expands from a first width that is approximately equal to a width of the RF port, to a second width.

17. The antenna structure of claim 15, further comprising an electrical conductor coupling the first side of the loop element to the second side loop element, providing an alternative path for electrical current, such that a first portion of energy applied to the RF port will travel a first distance around the loop element, and a second portion of the energy will travel a second distance that is shorter than the first distance via the electrical conductor.

18. The antenna structure of claim 15, wherein at least the elongated base, the arm, the first side, and the second side are formed of a monolithic flat metal material.

19. The antenna structure of claim 14, further comprising:

an inline reactance element included in series between the RF port and the elongated base, to tune resonance of the antenna structure.

20. The antenna structure of claim 14, further comprising:

a shunt reactance element coupling the second side of the loop element to the RF port, to tune resonance of the antenna structure.

* * * * *